United States Patent [19]

Synder

[11] Patent Number: 4,972,530

[45] Date of Patent: Nov. 27, 1990

[54] APPARATUS FOR AUTOMATICALLY FILLING A POOL WITH WATER

[76] Inventor: David T. Synder, 12167B Folsom Blvd., Ranco Cordova, Calif. 95670

[21] Appl. No.: 361,653

[22] Filed: Jun. 5, 1989

[51] Int. Cl.[5] ..... E04H 3/18

[52] U.S. Cl. ..... 4/508; 4/496

[58] Field of Search ..... 4/496, 507, 508; 137/428, 430; 285/322, 323, 8; 141/383, 384, 385

[56] References Cited

U.S. PATENT DOCUMENTS

| | | | |
|---|---|---|---|
| 2,159,150 | 5/1939 | Heintz | 285/322 |
| 3,074,746 | 1/1963 | Shames et al. | 285/322 |
| 3,739,405 | 6/1973 | Schmidt | 137/428 |
| 4,108,202 | 8/1978 | Schoepe | 285/322 |
| 4,342,125 | 8/1982 | Hodge | 4/508 |
| 4,574,405 | 3/1986 | Tams | 4/508 |
| 4,592,098 | 6/1986 | Magnes | 4/508 |
| 4,706,310 | 11/1987 | Magnes | 4/508 |
| 4,724,552 | 2/1988 | Kinkerhead et al. | 4/508 |
| 4,735,230 | 4/1988 | Detloff | 4/508 |

*Primary Examiner*—Henry J. Recla
*Assistant Examiner*—Keith Kupferschmid
*Attorney, Agent, or Firm*—Mark C. Jacobs

[57] ABSTRACT

Apparatus for automatically filling a pool or spa with water. The apparatus can be installed adjacent the pool or spa and includes a housing coupled to the preexisting water input of the pool or spa and such coupling is controlled by a float valve to either shut off or admit incoming water depending upon the level of the water in the pool or spa. The inlet pipe for water delivery to the pool enters the pool above or below water level.

14 Claims, 3 Drawing Sheets

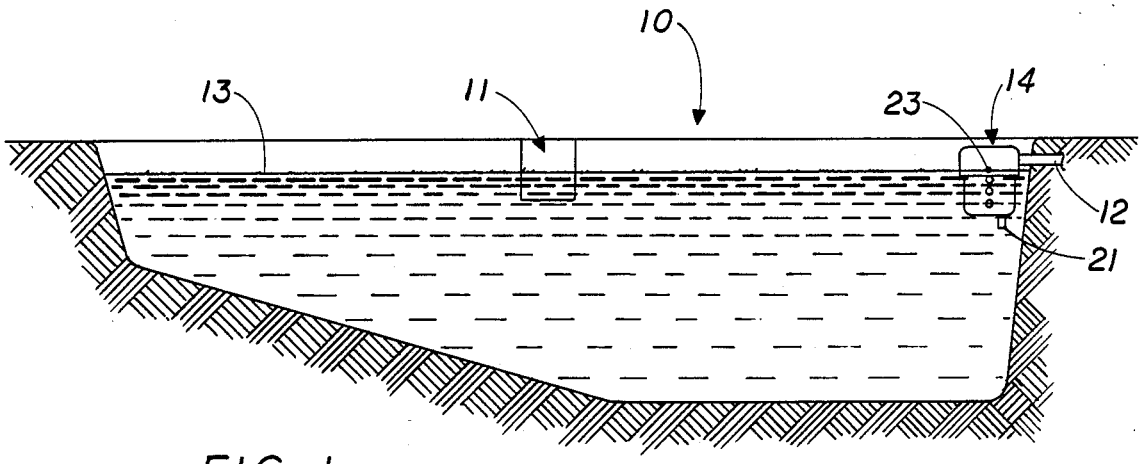
FIG. 1
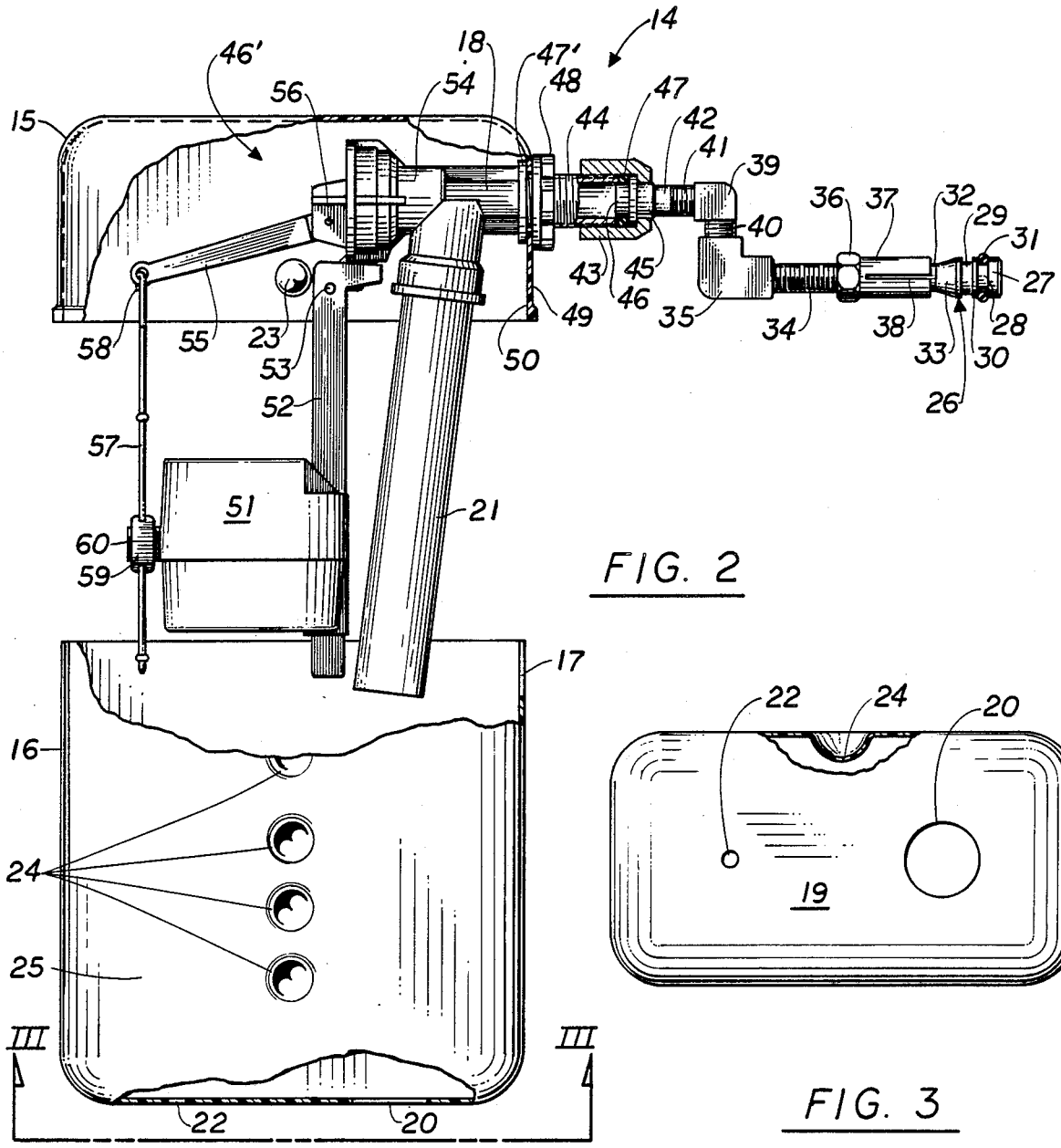
FIG. 2
FIG. 3

APPARATUS FOR AUTOMATICALLY FILLING A POOL WITH WATER

BACKGROUND OF THE INVENTION

1. FIELD OF THE INVENTION

The invention relates to water level control for pools or spas; and, more particularly, to apparatus coupled to the preexisting pool equipment for automatically adding water to the pool or spa as the water level decreases due to evaporation or splashing or the like.

2. DESCRIPTION OF THE PRIOR ART

The need to keep the level of water in a pool or the like up to a predetermined height is of critical importance in pools and spas, particularly where the pool or spa is equipped with a surface skimmer forming a part of the pool recirculating system. Such skimming apparatus generally includes an opening in the side of the pool for drawing in surface water, such opening extending above and below the desired pool high water level. Such skimming apparatus also generally contains a flapper float for allowing water to pass from the pool to the skimmer while prohibiting reverse flow. Such a float can become inoperative if the water level drops below the skimmer opening and this can cause malfunctioning of the system since air is drawn into the apparatus. Water in such pools is lost through splashing, leakage and evaporation and, thus, it is critical that the water level be maintained at a proper operating level.

In U.S. Pat. No. 4,323,125 to Hodge, a water level control for swimming pools is disclosed. However, such apparatus is not coupled to the preexisting water inlet of the pool but requires a hose or the like to be coupled to a coupling 26. Obviously, such a hose would then extend across the pool deck creating a hazard and thus highly undesirable, particularly for commercial pools.

There is a need for a water level control apparatus for a pool or spa which is inexpensive, easy to install and can be coupled to the preexisting water input of the pool or spa. Such apparatus should operate automatically and unattended.

SUMMARY OF THE INVENTION

It is an object of this invention to provide improved apparatus for automatically maintaining the water level in a pool or spa.

It is a further object of this invention to provide such apparatus which can automatically fill a pool or spa with water when the water level of the pool or spa drops below a preset level.

It is still further an object of this invention to carry out the foregoing objects utilizing the preexisting water input of the pool or spa so that the invention can be used on any conventional pool or spa without extraneous connections.

These and other objects are preferably accomplished by providing a housing that can be attached above or below the water level. The housing is coupled to the preexisting water input of the pool or spa and such coupling is controlled by a float valve to either shut off or admit incoming water depending upon the level of the water in the pool or spa.

BRIEF DESCRIPTION OF THE DRAWINGS

FIG. 1 is a vertical view, partly in section, of a conventional swimming pool or underground spa having automatic filling apparatus in accordance with the invention installed therein;

FIG. 2 is a vertical partly sectional view, and partly exploded, of the filling apparatus along of FIG. 1 removed from the pool;

FIG. 3 is a view taken along lines III-III of FIG. 2;

BRIEF DESCRIPTION OF THE PREFERRED EMBODIMENTS

Figure 4:
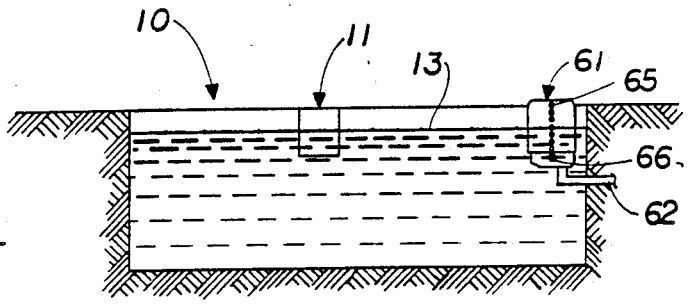
FIG. 4 is a vertical view, partly in section, similar to FIG. 1, of another type of filling apparatus.

Referring now to FIG. 1 of the drawing, a conventional inground swimming pool or spa 10 (referred to as pool hereinafter) is shown having a conventional surface skimmer 11 and an inlet 12 for selectively introducing water into pool 10. As seen in FIG. 1, inlet 12 is above the normal level 13 of water in pool 10. As particularly contemplated in the present invention, apparatus 14 is provided, coupled to inlet 12, for automatically adding water to pool 10.

As seen in FIG. 2, apparatus 14 is composed of a two piece housing (upper part 15 and lower part 16), both hollow on the interior, with one of the parts being telescopingly received in the other (such as lower part 16 telescoping into upper part 15) as seen in FIG. 1. Lower part 16 may have a cut-out area 17 adapted to straddle the conduit 18 of the apparatus mounted in upper part 15 as will be discussed. The bottom wall 19 (FIG. 3) of lower part 16 may also have a hole 20 for receiving down tube 21 therethrough (the lower end extending through hole 20 as seen in FIG. 1) as will also be discussed. A small leak hole 22 (FIG. 3) is provided through wall 19 for reasons to be discussed. The upper part 15 (see FIG. 1) has a dimple 23 punched inwardly toward the center thereof. This dimple 23 is vertically aligned with a plurality of spaced depressions or dimples 24 formed in outer wall 25 of lower part 16. When part 16 is assembled to part 15, the dimple 23 can enter one of the depressions 24 retaining the parts 15, 16 together (the parts 15, 16 may further be of such dimensions to press fit together) yet providing vertical adjustment so that the overall height of the assembled parts 15, 16 can be adjusted again for reasons to be discussed.

Apparatus 14 further includes a pipe interconnecting mandrel 26 (FIG. 2) terminating in a nosepiece 27. A pair of spaced grooves 28, 29 are provided on the outer surface of mandrel 26 separated by shoulder 30. Groove 28 is of a smaller diameter than groove 29 and a resilient 0-ring 31 is receivable in one of the grooves (such as groove 28). Mandrel 26 further includes a smooth outer surface cylindrical portion 32 interconnected to groove 29 by an outwardly flared portion 33. A threaded portion 34 extends from smooth portion 32 and is threadably receivable in an elbow 35. A nut 36 is threaded onto threaded portion 34 and a cylindrical collar 37 (smooth on its inner and outer surfaces) is slidably receivable on mandrel 26 between nut 36 and flared portion 33. As seen, a plurality of slits (only slit 38 visible in FIG. 2) are provided partway along and all the way through the wall of collar 37. The collar 37 thus acts as a grip as will be discussed.

A second elbow 39 is provided having an integral threaded shaft 40 threadably receivable in a threaded hole in elbow 35. A threaded shaft 41 threads into a like threaded hole in elbow 35 as shown and has a smooth cylindrical portion 42 extending through a hex nut 43. Hex nut 43 is internally threaded and threads onto threaded shaft 44 extending out of upper housing part 15. Nut 43 is retained on portion 42 by an enlarged collar portion 45 terminating in a lesser diameter cylindrical portion 46 receiving a resilient 0-ring 47 there around. It is to be understood that a central hollow through passage is provided from nosepiece 27 to the outlet of portion 46.

Thus, valve assembly 46, includes the aforementioned water inlet conduit 18 which has an integral washer 47, and threaded shaft 44. As heretofore discussed, threaded shaft 44 extends through an opening in the side wall 49 of upper housing part 15 with integral washer 47, abutting against the inner wall 50. A lock nut 48 is threaded onto shaft 44 and tightened against side wall 50 to retain upper part 15 between washer 47, and nut 48.

Valve assembly 46, further includes a float 51 movable on a rail 52 which rail 52 is pivotally connected via pivot assembly 53 to a valve chamber 54 in fluid communication with conduit 18. A lever 55 is pivotally connected via pivot assembly 56 to valve chamber 54. A connecting rod 57 is hooked at one hook end 58 to lever 55 and extends through both a C-shaped conventional squeeze-type clip 59 and an apertured boss 60 integral with float 51.

The internal mechanism of valve chamber 54 is well known in the fluid level control valve art and further discussion is deemed unnecessary. In operation, a change of water level in pool 10 opens or closes the valve within chamber 54 depending upon the position of float 51. That is, the up or down position of lever 55 opens or closes the valve.

When lever 55 is in the horizontal position, the valve is closed, and water pressure within valve chamber 54 exerts a force resisting downward movement of the lever 55 until the water level within housing parts 15, 16 has dropped sufficiently with respect to float 51 so that the added effective weight of float 51, acting through connecting rod 57 and lever 55 counterbalance the internal pressure; whereupon lever 55 drops and, in so doing, opens the valve in chamber 54 to water flow. Conversely, as the water flow again causes the water level to rise the internal pressure within valve chamber 54 tends to restrict upward movement of lever 55 until the buoyant force of float 51, transmitted through connecting rod 57 to lever 55 is sufficient to counterbalance the internal pressure.

Thus, in installation, the pool 10 is filled to the level desired (e.g., as seen in FIG. 1). If the water fill supply pipe leading into the pool is copper, 0-ring 31 is located in groove 28 as seen in FIG. 2. If pipe 12 is plastic, the 0-ring 31 is removed from groove 28 and located in groove 29. However, if pipe 12 is ¾ inch in inner diameter, and of course depending upon the outer diameter of mandrel 26, 0-ring 31 can be left in groove 28. Nut 36 is tightened which allows sleeve 37 to contact flared or tapered portion 33 of mandrel 26. The nosepiece 27 and 0-ring 31 end is inserted into the open end of pipe 12 about halfway until the 0-ring slips into pipe 12 without rolling off mandrel 26. The sleeve 37 is now inserted into pipe 12 as far as it will go and nut 36 is handtightened against sleeve 37. The elbows 35, 39 should hang down with shaft 41 horizontal. Nut 36 is now tightened against sleeve 37 and nut 43 is threaded to shaft 44 with end 46 entering shaft 44. Housing part 15 should hang parallel with the side of pool 10. After turning on the water so it enters pipe 12, clip 59 is adjusted up or down along rod 57 (moving float 51 up or down) so that the valve within chamber 54 turns off within ¼ inch of the desired water level. This level can be 1 ½ inches below the top thereof. The upper part 15 is now rotated so the assembly is upside down; tube 21 is removed, then the bottom part 16 is assembled into top part 15. The tube 21 is inserted through opening 20 into valve chamber 54. The assembled parts 15, 16 are rotated back to the position shown in FIG. 2 and tightened up. The orientation of elbows 39 and 35 can be changed to obtain the proper water level adjustment if apparatus 14 is too high or too low. The incoming water supply should be left on all of the time as apparatus 14 automatically opens and closes the valve within chamber 54 to admit water as needed into and out of tube 21. The small hole 22 (see FIG. 3) allows water to seep into the interior of assembled parts 15, 16 to provide the water for actuating float 51 and the aforementioned mating depressions 23, 24 are used to adjust the overall height of the housing parts 15, 16, as required.

Figure 5:
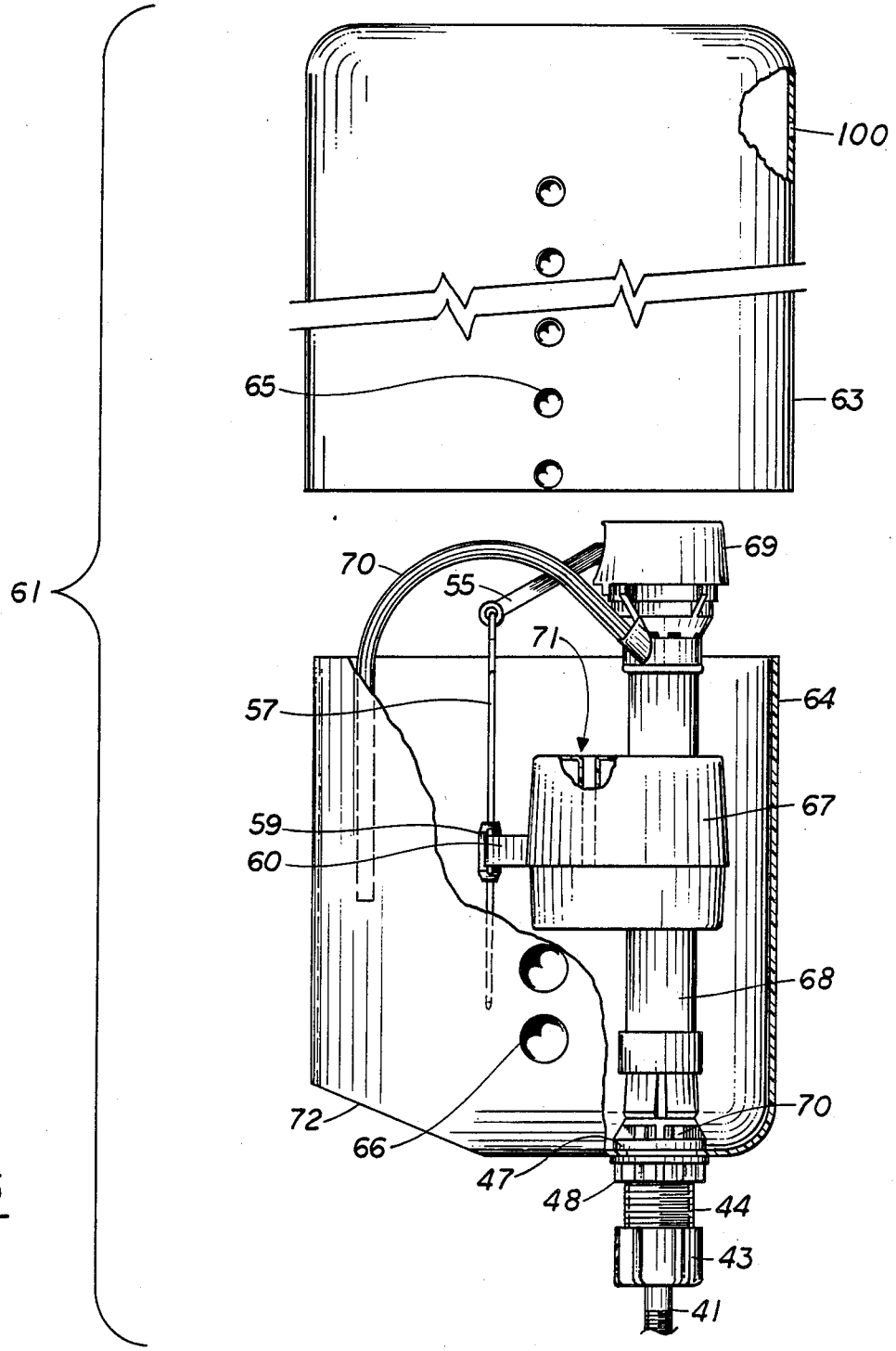
FIG. 5 is a vertical partly sectional view, and also partly exploded, of the filling apparatus along of FIG. 4 removed from the pool.

As seen in FIG. 4 wherein like numerals refer to like parts of the embodiment of FIGS. 1 to 3, apparatus 61 is shown and used where inlet pipe 62 is below the surface 13. Thus as shown in FIG. 5, apparatus 61 is again comprised of a two part housing 63, 64, upper housing 63 having dimples 65 adapted to mate with dimples 66 (FIG. 4) on lower housing 64 (as dimples or depressions 23, 24). The pipe coupling apparatus extending from hollow shaft 41 is identical to the apparatus heretofore discussed with respect to FIGS. 1 to 3 so further description or discussion is deemed unnecessary. However, in this embodiment, float 67 moves up and down on shaft 68 and the shaft 68 terminates in a valve chamber 69 having a float actuated valve therein. A tube 70 fluidly communicates with both the interior of housing 64 and valve chamber 69. Such valve assembly is available from Fluidmaster, Inc., of Anaheim, Calif., under Model No. 400A, adjustable anti-siphon valve. Tube 70 and outlet 70, are used to discharge the water below water level to reduce the noise that would result if the water squirted directly out of the valve.

Installing apparatus 61 is substantially identical to the installation of apparatus 14. Pool 10 is filled to level 13. The 0-ring 31 is installed again depending on the pipe material and diameter. Nut 36 is again tightened. The valve assembly is removed from housing 64. The nosepiece end 27 is inserted into inlet pipe 62 with sleeve 37 inserted as far as it will go. The nut 36 is tightened and the valve assembly is coupled to the fittings using nuts 43 and 48 as heretofore discussed. The float 67 is now submerged which fills the bottom with water through hole 71 as is known in the art. Again, clip 59 is used to adjust float 67 to the desired on-off level. The water is turned off, the valve assembly is disconnected from nut 43 and installed in housing 64 so that shaft 68's portion 44 extends out of a hole in the bottom of the housing 64 and which is then coupled to the outer fitting assembly. The float is centered and the top housing 63 is assembled until it hits the valve chamber 69 and the dimples 65 mate with dimples 66. Any necessary adjustments can now be made as heretofore discussed and nuts 43 is tightened. A cut-out area 72 is provided in the bottom of housing part 64, thus, when the inlet water is turned on, and pool water enters through area 72 into the interior of housing 64, float 67 moves up and down on shaft 68 to selectively open and close the valve in valve chamber 69 to close off or admit water into the pool when needed. A small air escape hole 100 in housing 63 allows the water level to rise and activate float 67.

Any convenient materials, such as brass for the various fittings, resilient 0-rings, plastic and brass nuts, plastic for the valve and housing parts, etc., can be used. Although specific structure has been disclosed for coupling the valve assemblies to a water input pipe, Type C pipe stopper plugs sold by Thaxton, Inc. of Gibsonia, Pa. can be adapted to the present invention by providing throughbores throughout. Similar plugs are described and claimed in U.S. Pat. Nos. 4,474,216 and 4,385,643. The split sleeve 37 wedges itself into the water input pipe and the 0-ring 31 fluidly seals the water connection. Of course, the size of the mandrel and related parts are chosen depending on the inside diameter of the fill pipe and the fact that sleeve 37 is not split all the way retains the same to the mandrel during installation. Any suitable float controlled valve assemblies can be used. In U.S. Pat. No. 4,342,125 to Hodge, the Fluidmaster valves are discussed as usable in water level control for swimming pools. Similar valves that can be easily converted for use in the subject invention are described and claimed in U.S. Pat. Nos. 3,669,138; 3,495,803; and 4,100,928.

The housing sections 15, 16 and 63, 64 muffle the sound of the internal operating parts. The small hole 22 in housing 16 of the FIG. 1 embodiment allows slow seepage of water to shut off the valve in valve chamber 54. Thus, aggressive splashing in the pool does not admit water into housings 15, 16 to cause the float 51 to oscillate up and down.

It can be seen that I have disclosed apparatus for automatically filling an unattended pool with water, which apparatus can be retrofitted to existing pool equipment. Although a specific embodiment of the invention is disclosed, variations thereof may occur to an artisan and the scope of the invention is to be determined only by the scope of the appended claims.

I claim:

1. Apparatus for automatically filling a contained body of water such as a pool or spa when the water level therein drops, said body of water having (a) a surface skimmer at the desired water level of the body of water for draining water form the contained body of water and (b) a water inlet pipe leading into the body of water for adding water thereto, said apparatus comprising:

a housing having a float actuated valve assembly mounted internally thereof, said housing adapted to be in fluid communication with said body of water;

a water inlet in fluid communication with said housing extending out of said housing; and pipe coupling means coupled to said water inlet and adapted to be coupled said water inlet pipe for fluidly coupling said water inlet to said pipe in a relatively fluid tight manner while permitting fluid flow therebetween, wherein said housing is comprised of two telescoping parts, said parts being longitudinally adjustable to vary the overall length thereof and, wherein the fluid communication between said housing and said body of water is provided by said housing having a bottom wall with a water outlet tube in fluid communication with both said valve assembly and said body of water and extending out all of the bottom wall of said housing, and a bleeder hole in said bottom wall also fluidly communicating the interior of said housing with said body of water.

2. In the apparatus of claim 1 wherein the float of said valve assembly is longitudinally adjustable with respect to said housing.

3. In the apparatus of claim 1 wherein the fluid communication between said housing and said body of water is provided by said housing having an apertured opening below said water level.

4. In the apparatus of claim 1 wherein said pipe coupling means includes a tubular mandrel adapted to be inserted into said water inlet pipe, said mandrel having a front nosepiece a radially outward diverging surface and a split sleeve receivable on said diverging surface of said nosepiece slidably mounted thereon and said sleeve being sized to slidably fit within said water inlet pipe, and a resilient O-ring mounted in a groove on said mandrel between said diverging surface and said nosepiece, said diverging surface diverging radially upward from said sleeve to said groove, said mandrel having a threaded shaft portion opposite said nosepiece and having a nut threaded thereon abutting against said sleeve forcing the same over the diverging surface of said mandrel thereby compressing said sleeve against an inner wall of said pipe, said O-ring also abutting against the inner wall of said pipe to provide a seal, and coaxially aligned throughbores fluidly communicating said mandrel and said water inlet.

5. In the apparatus of claim 4 wherein said sleeve is slit only partway therethrough.

6. In the apparatus of claim 1 wherein said housing has a side wall and said pipe coupling means is coupled to a shaft extending through the side wall of said housing into the interior thereof and fluidly coupled to said valve assembly, the float of said valve assembly being reciprocal along an axis normal to the central axis of said shaft.

7. In the apparatus of claim 1 wherein said housing is mounted within said body of water, the float of said valve assembly being disposed at the same level as the water level of said body of water, the fluid communication between the interior of said housing and said body of water being provided by said bleeder hole and a water outlet fluidly communicating the said body of water with the interior of said housing.

8. A apparatus for retrofitting a swimming pool that has a water inlet pipe for filling said pool, with a means for automatically filling said pool, said automatic water fill means comprising:

a housing having a float actuated valve assembly mounted internally thereof, a water inlet in fluid communication with said housing extending out of said housing; and pipe coupling means coupled to both said water inlet and said water inlet pipe, adapted to fluidly couple said water inlet to a water inlet pipe in a relatively fluid tight manner while permitting fluid flow therebetween, wherein said housing has a bottom wall with a water outlet tube in communication with both said valve assembly and the exterior of said housing and extending out of the bottom wall of said housing, and a bleeder hole in said bottom wall also fluidly communicating the interior of said housing with the exterior thereof.

9. In the apparatus of claim 8 wherein said housing is comprised of two telescoping parts, said parts being longitudinally adjustable to vary the overall length thereof.

10. In the apparatus of claim 8 wherein the float of said valve assembly is longitudinally adjustable with respect to said housing.

11. In the apparatus of claim 8 wherein said housing has an apertured opening in the lower part thereof.

12. An apparatus for retrofitting a swimming pool that has a water inlet pipe for filling said pool, with a means for automatically filling said pool, said automatic water fill means comprising:

a housing having a float actuated valve assembly mounted internally thereof, a water inlet in fluid communication with said valve assembly and extending out of said housing and a water outlet in fluid communication between said valve assembly and said pool; and pipe coupling means coupled to said water inlet and adapted to be coupled to said water inlet pipe to fluidly couple said water inlet to a water inlet pipe in a relatively fluid tight manner while permitting fluid flow therebetween, wherein said pipe coupling means includes a tubular mandrel adapted to be inserted into a water inlet pipe, said mandrel having a front nosepiece, a radially outward diverging surface, and a split sleeve receivable on a said diverging surface thereof rearwardly of said nosepiece slidably mounted thereon and said sleeve being sized to slidably fit within said water inlet pipe, and a resilient O-ring mounted in a groove on said mandrel between said diverging surface and said nosepiece, said diverging surface diverging radially upward from said sleeve to said groove, said mandrel having a threaded shaft portion opposite said nosepiece and having a nut threaded thereon for sliding said split sleeve onto said diverging surface and into a frictional fit with the inside of said water inlet pipe and coaxially aligned throughbores fluidly communicating said mandrel and said water inlet.

13. In the apparatus of claim 12 wherein said housing has a bottom wall and said pipe coupling means is coupled to a shaft extending upwardly within said housing through the bottom wall thereof to said valve assembly, the float of said valve assembly being reciprocal along an axis coincident with the axis of said shaft.

14. In the apparatus of claim 13 wherein said fluid communication is provided by an opening in said housing below said water level.

* * * * *

UNITED STATES PATENT AND TRADEMARK OFFICE
CERTIFICATE OF CORRECTION

PATENT NO. : 4,972,530

DATED : Nov. 27, 1990

INVENTOR(S) : David T. Synder

It is certified that error appears in the above-identified patent and that said Letters Patent is hereby corrected as shown below:

TITLE PAGE:

Item 19 & 76 change "Synder" to "Snyder".

Signed and Sealed this

Twenty-third Day of April, 1991

*Attest:*

HARRY F. MANBECK, JR.

*Attesting Officer*

*Commissioner of Patents and Trademarks*